US005102293A

United States Patent [19]

Schneider

[11] Patent Number: 5,102,293

[45] Date of Patent: Apr. 7, 1992

[54] UNSTACKING APPARATUS FOR REMOVING A PARTIAL STACK FROM A STACK OF SHEETS

[75] Inventor: Willi Schneider, Greifensee, Switzerland

[73] Assignee: Ingenieurburo Willi Schneider, Savognin, Switzerland

[21] Appl. No.: 560,575

[22] Filed: Jul. 31, 1990

[30] Foreign Application Priority Data

Oct. 12, 1989 [CH] Switzerland ..... 3729/89

[51] Int. Cl.[5] ..... B65H 3/52

[52] U.S. Cl. ..... 414/796; 271/42; 414/796.9

[58] Field of Search ..... 414/796, 796.6, 796.9; 271/42, 268

[56] References Cited

U.S. PATENT DOCUMENTS 4,055,258 10/1977 Schneider ..... 414/796
4,551,053 11/1985 Ishibashi ..... 271/42 X

FOREIGN PATENT DOCUMENTS 927699 5/1982 U.S.S.R. ..... 271/42

*Primary Examiner*—Robert J. Spar
*Assistant Examiner*—Janice Krizek
*Attorney, Agent, or Firm*—Young & Thompson

[57] ABSTRACT

Two vertically displaceable slides (5, 9) carry in horizontally movable fashion a tabletop (1) and, respectively, a gripper with an upper gripper jaw (6) and a gripper base (7). The gripper base (7) contains a horizontally displaceable blade (12) and supporting elements (24, 25) which are horizontally displaceable and also vertically movable with respect to the blade (12). A Stack of sheets is set up in front of the tabletop (1). The slides (5, 9) are lowered until the upper gripper jaw (6) rests on the sheet stack. The blade (12), previously retracted into the gripper base (7), is then made to pierce the stack of sheets at an exactly settable distance below the upper gripper jaw (6). The slides (5, 9) are slightly elevated in order to form a gap in the sheet stack with the blade (12). The supporting elements (24, 25) are pushed into the gap below the blade (12), and are then urged upwardly past the level of the blade (12) so that they alone bear the weight of the sheets resting thereon. Upon further elevation of the slides (5, 9) until the tabletop (1) can be introduced into the gap, the blade (12) thus cannot damage the sheets.

11 Claims, 4 Drawing Sheets

UNSTACKING APPARATUS FOR REMOVING A PARTIAL STACK FROM A STACK OF SHEETS

FIELD OF THE INVENTION

The invention relates to an unstacking apparatus for removing a partial stack from a stack of sheets resting on a supporting surface, with a tabletop, a horizontal adjustment device for executing horizontal relative movements between the tabletop and the afore-mentioned supporting surface, a gripper comprising an upper gripper jaw and a gripper base for seizing and holding an edge of a partial stack, and a vertical adjustment device for executing vertical relative motions between the tabletop and the gripper, on the one hand, and the supporting surface, on the other hand.

DESCRIPTION OF THE RELATED ART

In a conventional unstacking apparatus of this type (see Swiss-A-582,104), the gripper bottom consists of a blade-like lower gripper jaw which can be made to pierce a stack of sheets by horizontal shifting of the gripper while the top gripper jaw rests on the topside of the stack and slides therealong. The gripper thus seizes an edge of a partial stack of predetermined thickness in correspondence with the set spacing from the upper gripper jaw to the lower gripper jaw. The gripper can then be lifted to hoist the seized edge of the partial stack off the remaining residue of the sheet stack, and then the tabletop can be pushed in between the partial stack and the remaining residue of the sheet stack so that the partial stack moves onto the tabletop.

One disadvantage of the known unstacking apparatus resides in that individual sheets can be damaged by the sharp edge and/or top of the blade-like lower gripper jaw when the lower gripper jaw lifts an edge of a relatively thick, heavy partial stack off the remainder of the sheet stack to such an extent that the tabletop can subsequently be pushed in between the partial stack and the remainder of the sheet stack. The sharp edge and/or tip of the lower gripper jaw, however, is absolutely necessary for being able to penetrate into the sheet stack. Furthermore, there is the danger in the conventional unstacking apparatus that the upper gripper jaw displaces the uppermost sheet or uppermost sheets of the stack while sliding along the topside of the stack upon penetration of the bottom gripper jaw into the sheet stack.

SUMMARY OF THE INVENTION

It is an object of this invention to fashion the unstacking apparatus described hereinabove in such a way that the disadvantages of the conventional unstacking apparatus can be avoided and, in particular, also the edge of relatively thick and heavy partial stacks can be lifted off without damage to the sheets.

This object has been attained according to the invention by providing that the gripper base comprises a blade guide, a horizontal blade, and a blade drive mechanism for effecting horizontal movements of the blade with respect to the blade guide, as well as, beside the blade, at least one supporting element and a supporting element adjustment device for the execution of horizontal movements of the supporting element with respect to the blade guide, and that the gripper furthermore exhibits a supporting element rise and fall mechanism for the execution of vertical movements of the supporting element with respect to the blade.

In the unstacking apparatus according to this invention, damage to the sheets by the blade during the lifting of a partial stack edge can be avoided by providing initially only a quite small vertical relative movement between the gripper with the blade and the supporting surface with the sheet stack, after the blade has been horizontally plunged into the sheet stack with the upper gripper jaw resting on the topside of the sheet stack. The deflection of the partial stack edge at the edges and rims of the blade is then still minor. Besides, the partial stack still rests on the residual stack at a comparatively small spacing in front of the blade and laterally beside the blade, so that the partial stack weight to be carried by the blade is not as yet substantial. Then, beside the blade, the supporting elements can be pushed into the gap between the partial stack edge and the residual stack, formed by the small vertical relative motion; these supporting elements need not exhibit sharp edges and can also be of a sturdier structure than the blade. Subsequently, the supporting elements can be elevated with respect to the blade so that the supporting elements then carry the partial stack edge practically by themselves and clamp this edge with a predetermined force against the upper gripper jaw. Then the blade can be retracted and a further vertical relative motion can be effected between the gripper and the supporting surface with the sheet stack in order to enlarge the gap between the partial stack edge and the residual stack in the region of the gripper to such an extent that the gap can accommodate the tabletop.

Subsequently, a horizontal relative motion can then be brought about between the tabletop, on the one hand, and the supporting surface with the sheet stack as well as the gripper, on the other hand, either by introducing the tabletop in between the partial stack held by the gripper and the residual stack, or by pulling the partial stack onto the tabletop by the gripper and simultaneously moving the residual stack underneath the tabletop so that the partial stack comes to lie on the tabletop in its entirety.

BRIEF DESCRIPTION OF THE DRAWINGS

One embodiment of the unstacking apparatus according to this invention will be described in greater detail below with reference to the drawings wherein.

DESCRIPTION OF THE PREFERRED EMBODIMENTS

Figure 4:
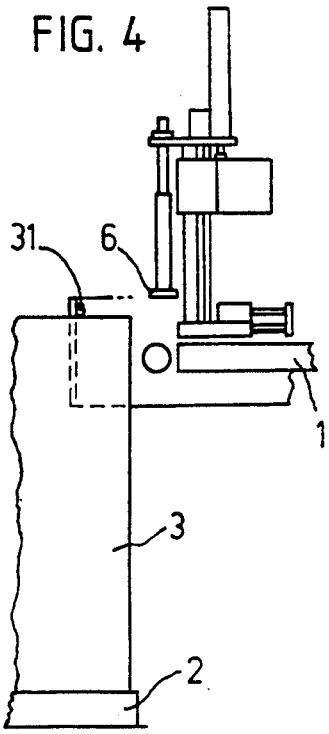
FIG. 4 shows, on a reduced scale, a schematic frontal view of parts of the unstacking apparatus and of a sheet stack from which a partial stack is to be removed.

The illustrated unstacking apparatus serves for removing a partial stack from a sheet stack resting on a supporting surface, by means of a tabletop 1. The supporting surface can be the floor or the topside of a pallet 2 lying on the floor, a stack of paper sheets 3 standing thereon (FIG. 4).

Figure 1:
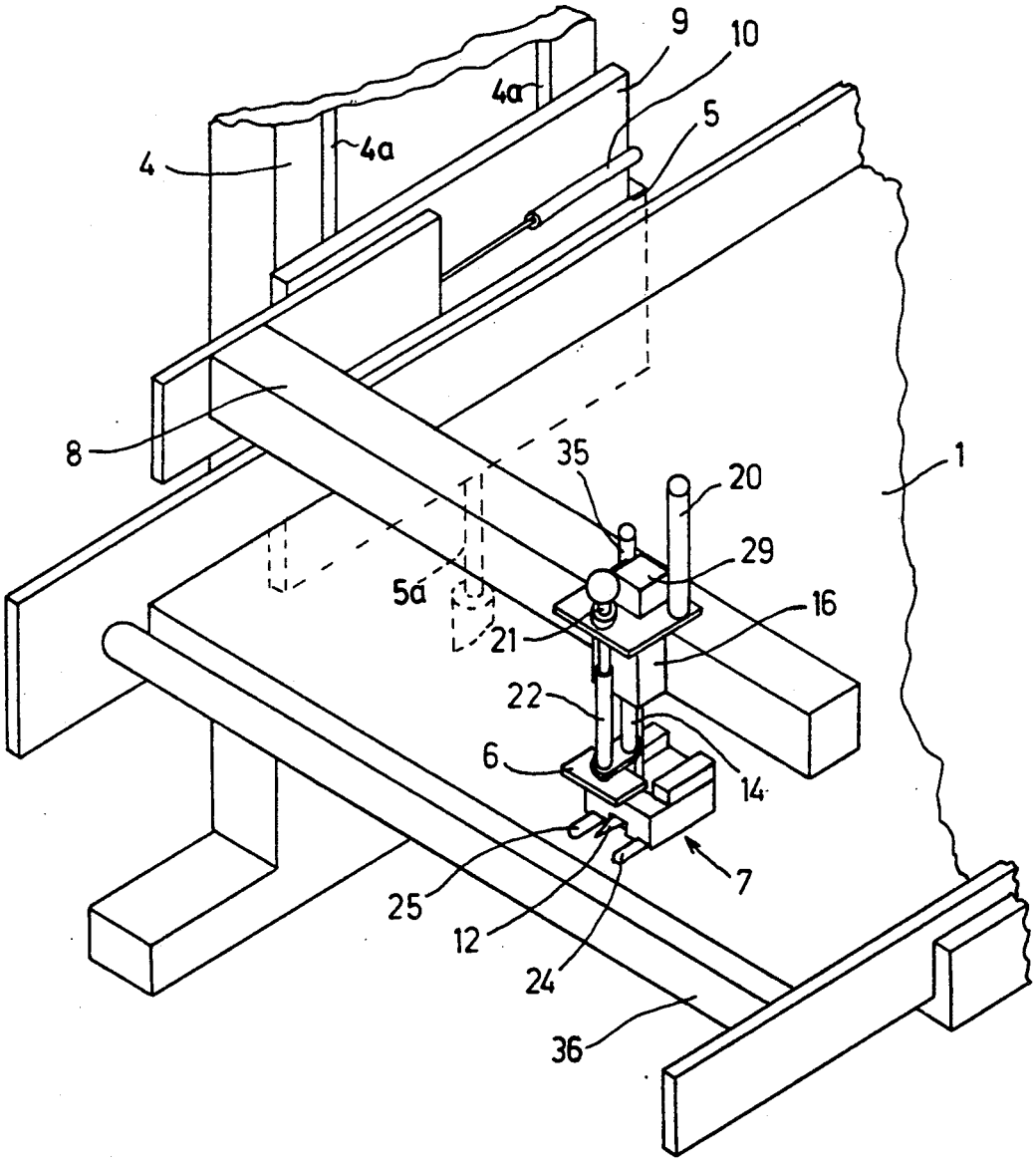
FIG. 1 shows schematically a perspective partial view of an unstacking apparatus.

The apparatus contains a horizontal adjustment device for the execution of horizontal relative motions between the tabletop 1 and the supporting surface and/or the pallet 2. The horizontal adjustment device consists, in the illustrated apparatus, of a table guideway 5 retained on a machine column 4 (FIG. 1), on which the tabletop 1 is arranged in a horizontally displaceable fashion, and of a drive means (not shown), for effecting horizontal displacements of the tabletop along the table guideway. However, in place thereof (or in addition thereto), the pallet 2 could also be horizontally displaceable by a drive means along a guide fixture (not shown).

The apparatus furthermore comprises a gripper with an upper gripper jaw 6 and a gripper base 7 for seizing and retaining a partial stack of the sheet stack 3, as well as a vertical adjustment device for the execution of vertical relative motions between the tabletop 1 and the gripper 6, 7, on the one hand, and the pallet 2, on the other hand. The vertical adjustment device consists, in the illustrated apparatus, of vertical guides 4*a* on the machine column 4, the table guideway 5, constituted by a slide, being vertically displaceable along these guides by means of a drive mechanism 5*a*. In place thereof (or additionally thereto), however, the pallet 2, or a carrier for the same, could also be vertically raised and lowered by means of a drive mechanism, not shown, while being guided along a vertical guide means, not illustrated.

The gripper 6, 7 is carried by a gripper carrier 8 arranged to be raised and lowered along with the tabletop 1 on the machine column 4. Preferably, the gripper carrier 8 is mounted to a second slide 9 likewise guided on the vertical guide means of the machine column 4 and being liftable and lowerable with respect to the table guideway 5 formed by the first slide by means of a drive mechanism (not illustrated). In this arrangement, the gripper carrier 8 can be mounted to the slide 9 to be horizontally movable and can be shifted horizontally with respect to the slide 9 by a drive mechanism 10.

The gripper base 7 contains a blade guide 11 (FIGS. 2, 3) wherein a horizontal blade 12 is guided to be horizontally movable. A pneumatic cylinder 13 is attached to the blade guide 11, this cylinder shifting the blade 12 with respect to the blade guide 11 between the left-hand final position according to FIG. 2 and a right-hand final position, in the horizontal direction. In the right-hand end position, the free end of the blade 12 is retracted into the blade guide 11. The blade guide 11 is attached to the bottom end of a vertical bar 14, the upper end of which is attached to a plate 15. The bar 14 is guided to be freely vertically displaceable in a block 16 mounted to the gripper carrier 8. The downward motion of the bar 14 with respect to the gripper carrier 8 is limited by stop elements 18 and 19 carried by the plate 15 and cooperating with the topside of the block 16 and, respectively, the gripper carrier 8. While the stop element 18 is rigidly mounted to the plate 15, the stop element 19 is carried by the plunger of a pneumatic cylinder 20 attached to the plate 15. By operating the pneumatic cylinder 20, the stop element 19 is moved downwards with respect to the plate 15 whereby the bottom end position of the plate 15 and of the bar 14 is adjusted in the upward direction with respect to the gripper carrier 8. The plate 15 also carries the upper gripper jaw 6. The vertical spacing between the upper gripper jaw 6 and the blade guide 11 and/or the blade 12 is adjustable; this is done in the illustrated embodiment by turning a screw 21 rotatably arranged in the plate 15 (FIG. 2), this screw being threaded into a sleeve 22. The upper gripper jaw 6 is attached to the lower end of this sleeve. Of course, the sleeve 22 must not turn with the screw 21; in order to achieve this, a strap 23 is attached to the sleeve 22 and is guided on the bar 14 in a vertically displaceable fashion.

The gripper base 7 furthermore contains, besides the blade 12, at least one supporting element. In the illustrated embodiment, respectively one supporting element 24 and 25 (FIGS. 2, 3) is arranged on both sides of the blade 12. The supporting elements 24 and 25 are guided to be horizontally displaceable in a supporting element guide means 26. Respectively one pneumatic cylinder 27 and 28 is attached for each supporting element 24, 25 on the supporting element guide means 26; this cylinder displaces the supporting element with respect to the supporting element guide 26 between the left-hand final position according to FIG. 2 and a right-hand final position, in the horizontal direction. In the right-hand end position, the free ends of the supporting elements 24 and 25 are retracted into the supporting element guide 26. The supporting element guide 26 and the pneumatic cylinders 27 and 28 form a supporting element adjustment device for the execution of horizontal movements of each supporting element with respect to the blade guide 11. The supporting element guide means 26 is guided to be vertically displaceable on the bar 14 carrying the blade guide 11, and a pneumatic cylinder 29 with a tie rod 30 is attached to the plate 15 (FIG. 2), the supporting element guide means 26 being attached to the lower end of this tie rod. The pneumatic cylinder 29 and the means for guiding the supporting element guide 26 along the vertical bar 14 constitute an embodiment of a supporting element rise and fall mechanism for executing vertical movements of the supporting elements 24 and 25 with respect to the blade 12.

By means of the unstacking apparatus, it is possible to withdraw, from a sheet stack 3 (FIG. 4) standing on a supporting surface, for example on the pallet 2, partial stacks of an exactly preselectable thickness and/or sheet number, in the manner described hereinbelow with reference to FIGS. 4 through 17.

The processes described hereinbelow are automatically performed by a control facility, not shown, which regulates the corresponding drive mechanisms.

In the rest condition, the plate 15 rests with the stop 18 on the block 16 of the gripper carrier 8; the tabletop 1 is located at some level at which previously a partial stack had been pushed away thereby, beside the sheet stack resting on the supporting surface or pallet 2 (FIG. 4). The blade 12 of the gripper base 7 is retracted into the blade guide 11, and the supporting elements 24 and 25 are retracted into the supporting element guide means 26.

First of all, if necessary, a vertical relative movement is executed between the tabletop 1 as well as the gripper carrier 8, on the one hand, and the pallet 2, on the other hand. This is done in the illustrated embodiment by lifting (or lowering) the table guideway 5 along the vertical guides of the machine column 4 until the upper gripper jaw 6, as shown in FIG. 4, is located by a certain distance higher than the topside of the sheet stack 3. The attainment of this level is determined by means of a photocell unit 31 (FIG. 4) connected with the tabletop 1; this unit transmits a signal when it reaches the topside of the sheet stack 3.

Figure 5:
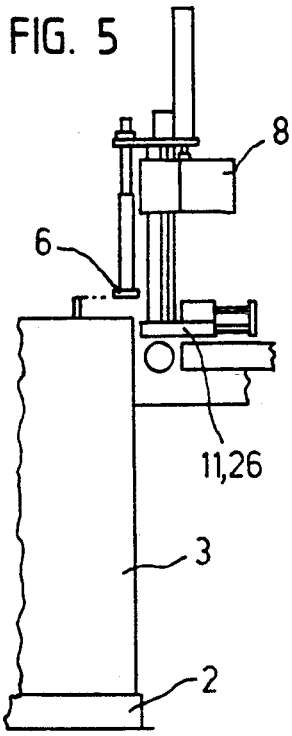
FIGS. 5–17 show views identical to FIG. 4 with respectively different positions of the components during the course of removing a partial stack.

Then, at least the gripper carrier 8 is moved horizontally toward the left (or the supporting surface 2 with the sheet stack 3 is moved toward the right) until, as shown in FIG. 5, the upper gripper jaw 6 is located vertically above the sheet stack 3 and the blade guide 11 as well as the supporting element guide means 26 are located at a small distance beside the sheet stack 3. The gripper carrier 8 can be moved to the left by displacement with respect to the slide 9 by means of the hydraulic cylinder 10 (FIG. 1); however, the carrier could also be connected in a horizontally immovable fashion to the tabletop 1 and be moved toward the left jointly with the latter with respect to the table guideway 5. Attainment of the position according to FIG. 5 can be indicated, for example, by a photocell unit 32 (FIG. 3) arranged in the supporting element guide means 26, this unit determining the distance between the supporting element guide means 26 and the sheet stack 3.

Figure 6:
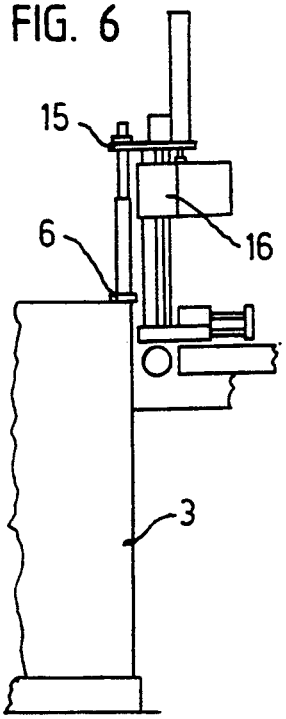

Then, again a vertical relative movement is performed between the tabletop 1 and the gripper carrier 8, on the one hand, and the pallet 2, on the other hand, in the illustrated embodiment by lowering of the table guideway 5 and of the second slide 9 along the machine column 4 until the upper gripper jaw 6, as shown in FIG. 6, rests on the topside of the sheet stack 3. When the topside of the sheet stack 3 comes into contact with the upper gripper jaw 6, it lifts, by way of this gripper jaw, the plate 15 with the stop 18 slightly off the block 16. This is detected by a switch 33 arranged in the block 16 (FIGS. 2, 3) which stops the downward movement of the two slides 5 and 9. The upper gripper jaw 6 then rests on the sheet stack 3 with a predetermined force, corresponding to the weight of the plate 15 and the parts attached to the latter. If desired, the predetermined contact force can be varied by weight-exerting or weight-relieving means. One example of such a means is shown schematically in FIG. 3 in the form of a compression spring 34 retained in a sleeve 35 which latter is mounted in the plate 15 to be vertically adjustable. The lower end of this compression spring rests on the topside of the gripper carrier 8. The compression spring 34 transfers a portion of the weight of the plate 15 and of the parts carried by the latter directly to the gripper carrier 8. The magnitude of the portion of this weight absorbed by the compression spring 34 can be altered by vertical adjustment of the sleeve 35 with respect to the plate 15.

Figure 2:
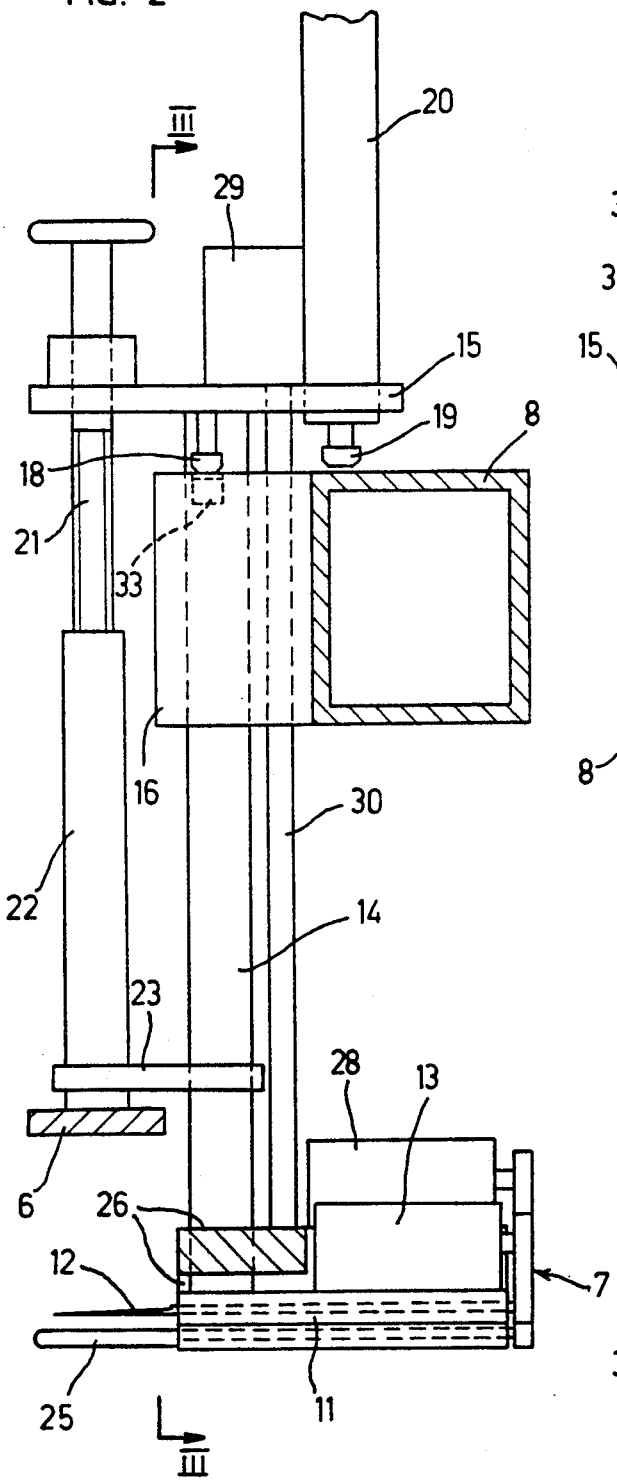
FIG. 2 shows, on an enlarged scale, a lateral view of the gripper of the unstacking apparatus in a sectional view along line II—II in FIG. 3.
Figure 7:
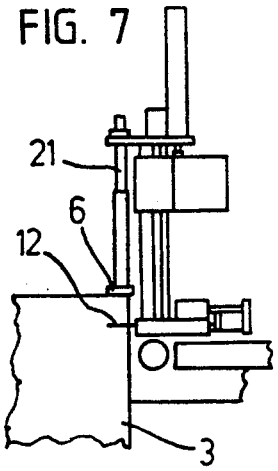

Thereafter, the pneumatic cylinder 13 (FIGS. 2, 3) is actuated in order to plunge the blade 12, as shown in FIG. 7, horizontally into the sheet stack 3. The point of penetration is located beneath the topside of the sheet stack 3 by a length which is equal to the vertical spacing of the blade 12 from the upper gripper jaw 6, set by turning the screw 21 (FIG. 2). On account of the predetermined contact force of the upper gripper jaw 6, a specific number of individual sheets of the stack 3 corresponds practically exactly to this length.

Figure 8:
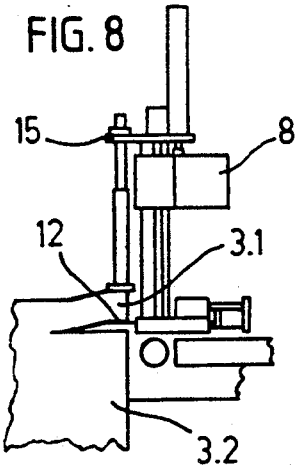

Subsequently, the plate 15 and thus, by way of the bar 14, the blade guide 11 and the blade 12 are lifted by a first, predetermined small distance, for example by raising the table guideway 5 and the second slide 9 and thus the gripper carrier 8. Owing to this upward movement, the blade 12 lifts a region of the edge of a partial stack 3.1, adjacent to the blade, slightly off the remainder of the sheet stack 3.2, as illustrated in FIG. 8.

Figure 3:
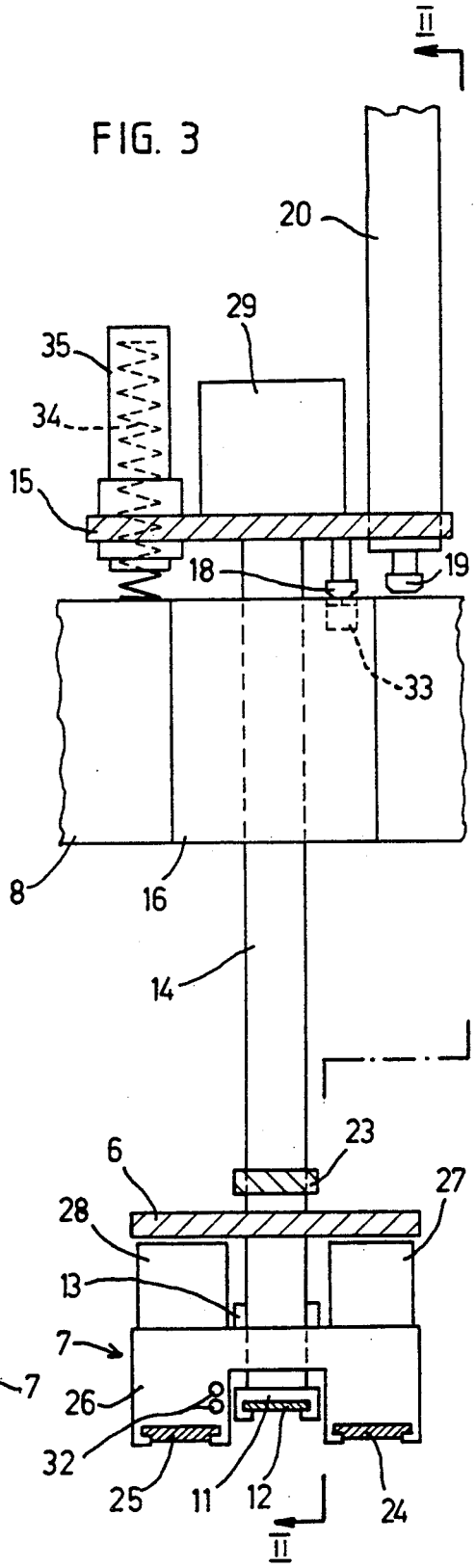
FIG. 3 shows a view of the gripper from the left-hand side, in a section along line III—III in FIG. 2.
Figure 9:
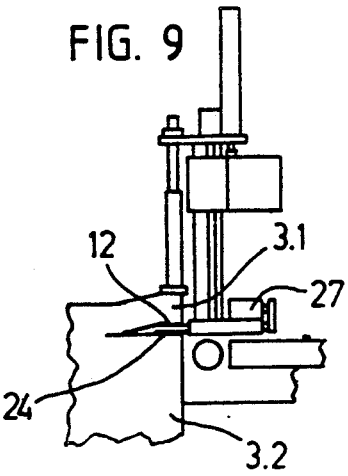

Then, as shown in FIG. 9, the supporting elements 24, 25 are introduced into the thus-formed gap between a region of the edge of the partial stack 3.1 and the residual stack 3.2, by operating the pneumatic cylinders 27, 28 (FIG. 3).

Figure 10:
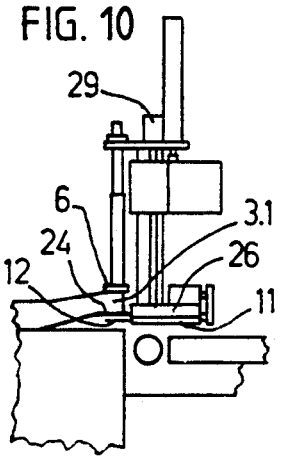

Subsequently, by actuating the supporting element lifting cylinder 29, the supporting element guide 26 and thus the supporting elements 24 and 25 are moved upwards with a predetermined force with respect to the blade guide 11 in order to fixedly clamp the aforementioned region of the edge of the partial stack 3.1 against the upper gripper jaw 6. The supporting elements 24 and 25 thereafter are located, as shown in FIG. 10, at a higher level than the blade 12 and bear the edge of the partial stack 3.1 on their own.

Figure 11:
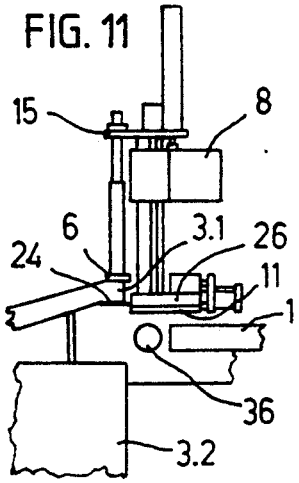

Then the blade 12 is retracted into the blade guide 11 by operating the pneumatic cylinder 13. Thereafter the table guideway 5 and the second slide 9 are moved further in the upward direction by a second, predetermined length, in order to make the gap between the supporting finger guide 26 and/or the blade guide 11 and the topside of the residual stack 3.2 so wide, by lifting the plate 15, that the tabletop 1 can be introduced into the gap and so that the tabletop 1 can be raised to the level of this gap, as shown in FIG. 11.

Figure 12:
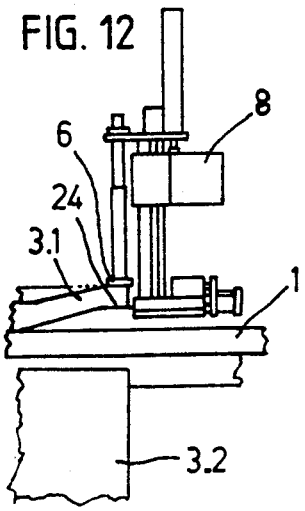

Subsequently, a horizontal relative movement is executed between the tabletop 1, on the one hand, and the pallet 2 as well as the gripper carrier 8, on the other hand; in the illustrated embodiment of the invention, this is done by shifting the tabletop 1 along the table guideway 5 horizontally toward the left. The tabletop 1 enters with its left rim, in front of which a rotatable separating roll 36 has been preferably mounted and is now being driven, into the gap between the region of the edge of the partial stack 3.1, supported by the supporting elements 24 and 25, and the topside of the residual stack 3.2. The tabletop 1 with the separating roll 36 also lifts, during this step, the zones of the right-hand edge of the partial stack 3.1 more remote from the supporting elements 24, 25 and initially sagging downwardly still (in certain cases down to the topside of the residual stack 3.2), onto the topside of the tabletop. Simultaneously with the horizontal shifting of the tabletop 1 along the table guideway 5, the table guideway 5—and with it also the second slide 9—can be moved along the machine column 4 somewhat in the upward direction so that the separating roll 36 and the tabletop 1 enter with an oblique,rising slope into the gap between the partial stack 3.1 and the residual stack 3.2. In FIG. 12, the tabletop 1 is illustrated while being inserted between the partial stack 3.1 and the residual stack 3.2. The zone of the right-hand edge of the partial stack 3.1, lying in the region of the supporting elements 24, 25, is clamped in place between the supporting elements and the upper gripper jaw 6 whereas the zones of the partial stack 3.1 more remote from the supporting elements 24, 25 are now located on the tabletop 1.

Figure 13:
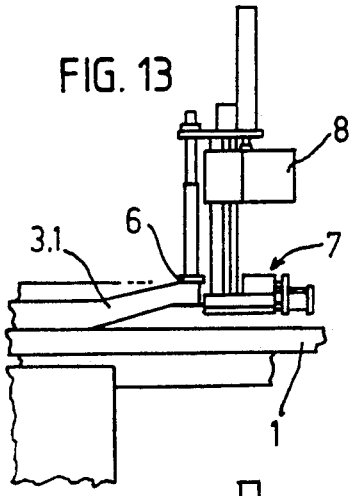

At this point, if desired, the gripper carrier 8 can be shifted toward the right along the slide 9 by means of the hydraulic cylinder 10 so that the gripper 6, 7 pulls the partial stack 3.1 increasingly onto the tabletop 1, as shown in FIG. 13.

Figure 14:
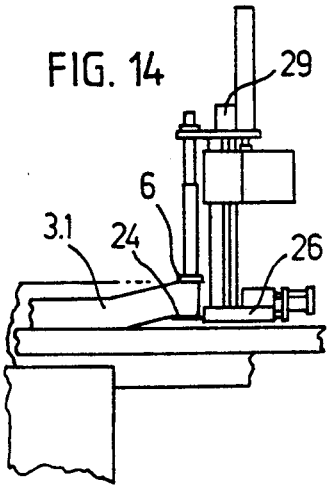

Then, the pneumatic cylinder 29 is actuated to move the supporting element guide means 26 and thus the supporting elements 24, 25 again in the downward direction with respect to the blade guide 11 and the upper gripper jaw 6, as illustrated in FIG. 14. Thereby the clamping fixation of the edge of the partial stack 3.1 between the supporting elements 24, 25 and the upper gripper jaw 6 is eliminated.

Figure 15:
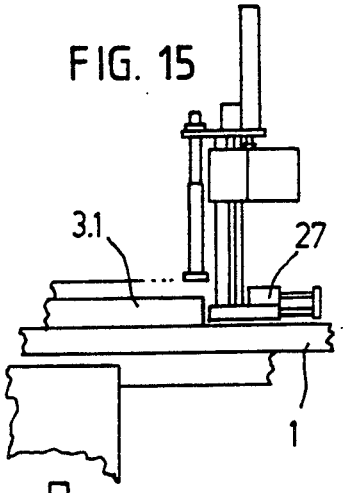

Thereafter the pneumatic cylinders 27 and 28 are operated in order to pull the supporting elements 24 and 25 away from underneath the edge of the partial stack 3.1 so that also this edge of the partial stack 3.1 drops onto the tabletop 1, as shown in FIG. 15.

Figure 16:
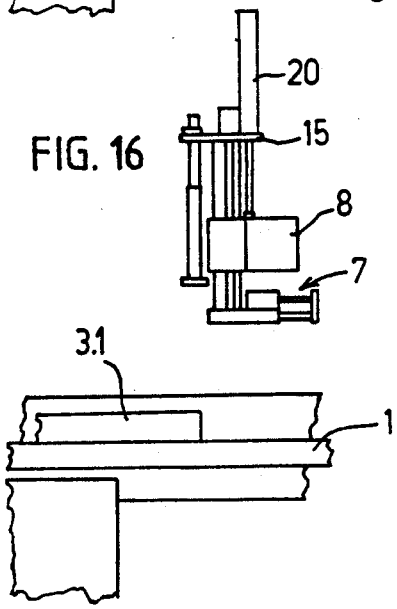

Thereafter a vertical relative movement between the plate 15 and the tabletop 1 is executed in order to lift the gripper base 7 beyond the level of the partial stack 3.1 disposed on the tabletop 1, as shown in FIG. 16. In the illustrated embodiment, the pneumatic cylinder 20 is operated for this purpose in order to adjust the plate 15 in the upward direction with respect to the gripper carrier 8. Additionally, the gripper carrier 8 itself can also be moved upwards by moving the second slide 9 (FIG. 1) upwardly along the machine column 4 with respect to the first slide 5 constituting the table guideway.

Figure 17:
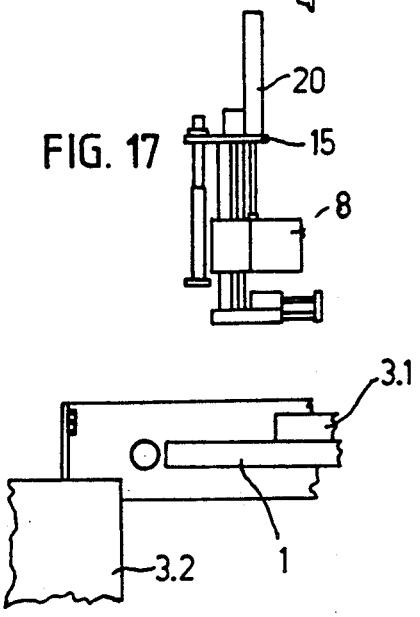

A renewed horizontal relative motion between the tabletop 1 and the pallet 2—by horizontal displacement of the tabletop 1 along the table guideway 5— then returns the tabletop 1 into its starting position with respect to the residual stack 3.2, as shown in FIG. 17. The partial stack 3.1 can then be pushed away from the tabletop 1. Thereafter the plate 15 is again lowered onto the gripper carrier 8, by actuation of the pneumatic cylinder 20, and optionally the second slide 9 is again lowered onto the first slide 5. The unstacking apparatus then is ready again for the removal of another partial stack from the residual stack 3.2.

An additional advantage of the construction and mode of operation of the unstacking apparatus according to this invention resides in that the unstacking apparatus can be readily designed for the parallel processing of simultaneously two (or even more) sheet stacks. The unstacking apparatus depicted in the drawings contains only one gripper 6, 7, carried by a plate 15, for the removal of partial stacks from only a single stack 3 of sheets. However, it is easily possible to arrange at the gripper carrier 8 a second block 16 with a second gripper 6, 7 at a spacing from and in parallel to the first gripper 6, 7 and being of identical construction as the latter. In such a case, two sheet stacks 3 can be set up in side-by-side relationship on the supporting surface 2, for example a pallet. Then, with the tabletop 1 performing the aforedescribed movements, and with the pneumatic cylinders 13, 27, 28, 29 and 20 of the two grippers being in each case operated simultaneously in the aforedescribed way, the apparatus will simultaneously remove from both sheet stacks respectively one partial stack with exactly the same number of sheets, wherein both partial stacks come to lie simultaneously on the tabletop 1 and then are pushed further by the latter.

What is claimed is:

1. Unstacking apparatus for the removal of a partial stack from a sheet stack (3) disposed on a supporting surface (2), with a tabletop (1) mounted on a table guideway (5) horizontally movable relative to the aforementioned supporting surface (2), a gripper comprising an upper gripper jaw (6) and a gripper base (7) for seizing and holding an edge of a partial stack (3.1), and a vertical adjustment device for executing vertical relative motions between the tabletop (1) and the gripper (6, 7), on the one hand, and the supporting surface (2), on the other hand, the gripper base (7) containing a blade guide (11), a horizontal blade (12), and a blade derive mechanism (13) for effecting horizontal motions of the blade (12) with respect to the blade guide (11), at least one supporting element (24, 25) mounted beside the blade, and a supporting element adjustment device (26, 27, 28) for executing horizontal movements of the supporting element (24, 25) with respect to the blade guide (11); the gripper (6, 7) furthermore comprising a supporting element rise and fall mechanism (29, 30) for executing vertical movements of the supporting element (24, 25) with respect to the blade (12), and a gripper carrier (8) which guides an element (14) carrying the upper gripper jaw (6) and the blade guide (11) in a freely vertically displaceable fashion.

2. Unstacking apparatus according to claim 1, characterized in that it furthermore contains a means (4, 9, 14, 16, 20) for executing vertical relative motions between the blade guide (11), as well as the upper gripper jaw (6), on the one hand, and the tabletop (1), on the other hand.

3. Unstacking apparatus according to claim 1, characterized in that the downward movability of the element (14) carrying the upper gripper jaw (6) and the blade guide (11) is limited with respect to the gripper carrier (8) by cooperating stop elements (16, 18, 19), of which at least one (19) is vertically adjustable for adjusting the lower end position of the aforementioned element (14) by means of a drive mechanism (20).

4. Unstacking apparatus according to claim 1, characterized by adjustable weight-modifying means (34, 35) for varying the force required for lifting the element (14) carrying the upper gripper jaw (6) and the blade guide (11).

5. Unstacking apparatus according to claim 1, characterized in that the tabletop (1) is arranged in a horizontally displaceable fashion on the table guideway (5) retained on a machine column (4).

6. Unstacking apparatus according to claim 5, characterized in that the table guideway (5) is a slide arranged on the machine column (4) to be vertically displaceable.

7. Unstacking apparatus according to claim 6, characterized in that the gripper carrier (8) is arranged on a second slide (9) guided on the machine column (4) to be vertically displaceable, the second slide being liftable and lowerable with respect to the first-mentioned slide (5).

8. Unstacking apparatus according to claim 7, characterized in that the gripper carrier (8) is horizontally displaceable by means of a drive mechanism (10) with respect to the second slide (9).

9. Unstacking apparatus according to claim 6, characterized by a control unit for automatically, in succession, (a) operating the vertical adjustment device (4) for lowering the table guideway (5) and the gripper carrier (8) until the upper gripper jaw (6) rests on the topside of a sheet stack (3), (b) operating the blade drive mechanism (13) for plunging the blade (12) into the sheet stack (3), (c) thereafter operating the vertical adjustment device (4) for lifting the table guideway (5) and the gripper carrier (8) by a first predetermined distance in order to lift a portion of the edge of a partial stack (3.1) off the remaining residue (3.2) of the sheet stack (3), (d) subsequently operating the supporting element adjustment device (26, 27, 28) for inserting the supporting element (24, 25) underneath the partial stack edge supported by the blade (12), (e) thereafter operating the supporting element rise and fall device (29, 30) for raising the supporting element (24, 25) with respect to the blade with a predetermined force, (f) operating the blade drive mechanism (13) in order to pull the blade (12) away horizontally from underneath the edge of the partial stack (3.1), (g) thereafter operating the vertical adjustment device (4) for the further raising of the table guideway (5) and of the gripper carrier (8) by a second predetermined distance, (h) then operating the table guideway (5) for the horizontal displacement of the tabletop (1) between the partial stack (3.1) and the remaining residue (3.2) of the sheet stack (3), (i) operating the supporting element rise and fall device (29, 30) for lowering the supporting element (24, 25) with respect to the blade (12), (j) operating the supporting element adjusting device (26, 27, 28) in order to pull the supporting element (24, 25) horizontally from underneath the edge of the partial stack (3.1).

10. Unstacking apparatus for the removal of a partial stack from a sheet stack (3) disposed on a supporting surface (2), with a tabletop (1) mounted on a table guideway horizontally movable relative to the aforementioned supporting surface (2), a gripper comprising an upper gripper jaw (6) and a gripper base (7) for seizing and holding an edge of a partial stack (3.1), and a vertical adjustment device for executing vertical relative motions between the tabletop (1) and the gripper (6, 7), on the one hand, and the supporting surface (2), on the other hand, characterized in that the gripper base (7) contains a blade guide (11), a horizontal blade (12), and a blade drive mechanism (13) for effecting horizontal motions of the blade (12) with respect to the blade guide (11) and to the upper gripper jaw, at least one supporting element (24, 25) mounted beside the blade, and a supporting element adjustment device (26, 27, 28) for executing horizontal movements of the supporting element (24, 25) with respect to the blade guide (11) and to the upper gripper jaw; and that the gripper (6, 7) furthermore comprises a supporting element rise and fall mechanism (29, 30) for executing vertical movements of the supporting element (24, 25) with respect to the blade (12).

11. Unstacking apparatus for the removal of a partial stack from a sheet stack (3) disposed on a supporting surface (2), with a tabletop (1) mounted on a table guideway horizontally movable relative to the aforementioned supporting surface (2), a gripper comprising an upper gripper jaw (6) and a gripper base (7) for seizing and holding an edge of a partial stack (3.1), and a vertical adjustment device for executing vertical relative motions between the tabletop (1) and the gripper (6, 7), on the one hand, and the supporting surface (2), on the other hand, characterized in that the gripper base (7) contains a blade guide (11), a horizontal blade (12), and a blade drive mechanism (13) for effecting horizontal motions of the blade (12) with respect to the blade guide (11) and to the upper gripper jaw, at least one supporting element (24, 25) mounted beside the blade, and a supporting element adjustment device (26, 27, 28) for executing horizontal movements of the supporting element (24, 25) with respect to the blade guide (11) and to the upper gripper jaw; that the gripper (6, 7) furthermore comprises a supporting element rise and fall mechanism (29, 30) for executing vertical movements of the supporting element (24, 25) with respect to the blade (12); and that a detector device (33) is provided for stopping the vertical adjustment device when the upper gripper jaw rests on a sheet stack with a predetermined force.

* * * * *